United States Patent [19]

McCartney

[11] 4,245,255

[45] Jan. 13, 1981

[54] IMPLOSION PROTECTION FOR TV TUBES

[75] Inventor: John S. McCartney, Corning, N.Y.

[73] Assignee: Corning Glass Works, Corning, N.Y.

[21] Appl. No.: 29,567

[22] Filed: Apr. 13, 1979

[51] Int. Cl.[3] ..... H01J 29/87

[52] U.S. Cl. ..... 358/245; 220/2.1 A

[58] Field of Search ..... 358/245; 220/2.1 A, 220/2.3 A

[56] References Cited

U.S. PATENT DOCUMENTS

| | | | |
|---|---|---|---|
| 2,123,957 | 6/1934 | Orth | 220/2.1 A |
| 2,236,708 | 5/1939 | Grimditch | 220/2.1 A |
| 2,799,123 | 10/1950 | Steenis | 220/2.1 A |
| 2,907,906 | 5/1956 | Swedlund | 220/2.2 |

FOREIGN PATENT DOCUMENTS

| | | | |
|---|---|---|---|
| 1242763 | 6/1967 | Fed. Rep. of Germany | 200/2.1 A |

*Primary Examiner*—Howard W. Britton

*Attorney, Agent, or Firm*—John P. DeLuca; Burton R. Turner

[57] ABSTRACT

There has been provided a television tube having a funnel, panel, and neck portion fused together in a conventional manner. A circumferential implosion protection controlled surface discontinuity is formed in a rearward portion of the funnel for establishing a stress concentration location near a point of maximum stress therefor, such that in the event of a destructive impact to the panel, the tube will crack along the controlled surface discontinuity and reduce the implosion potential of the tube.

12 Claims, 10 Drawing Figures

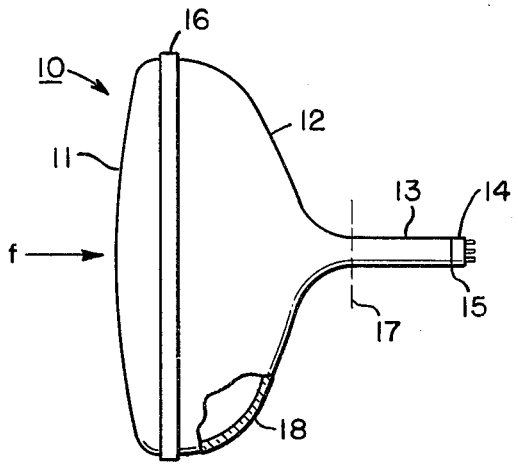
FIG. 1 (PRIOR ART)
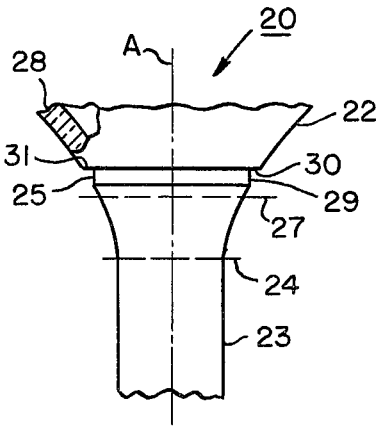
FIG. 2 (PRIOR ART)
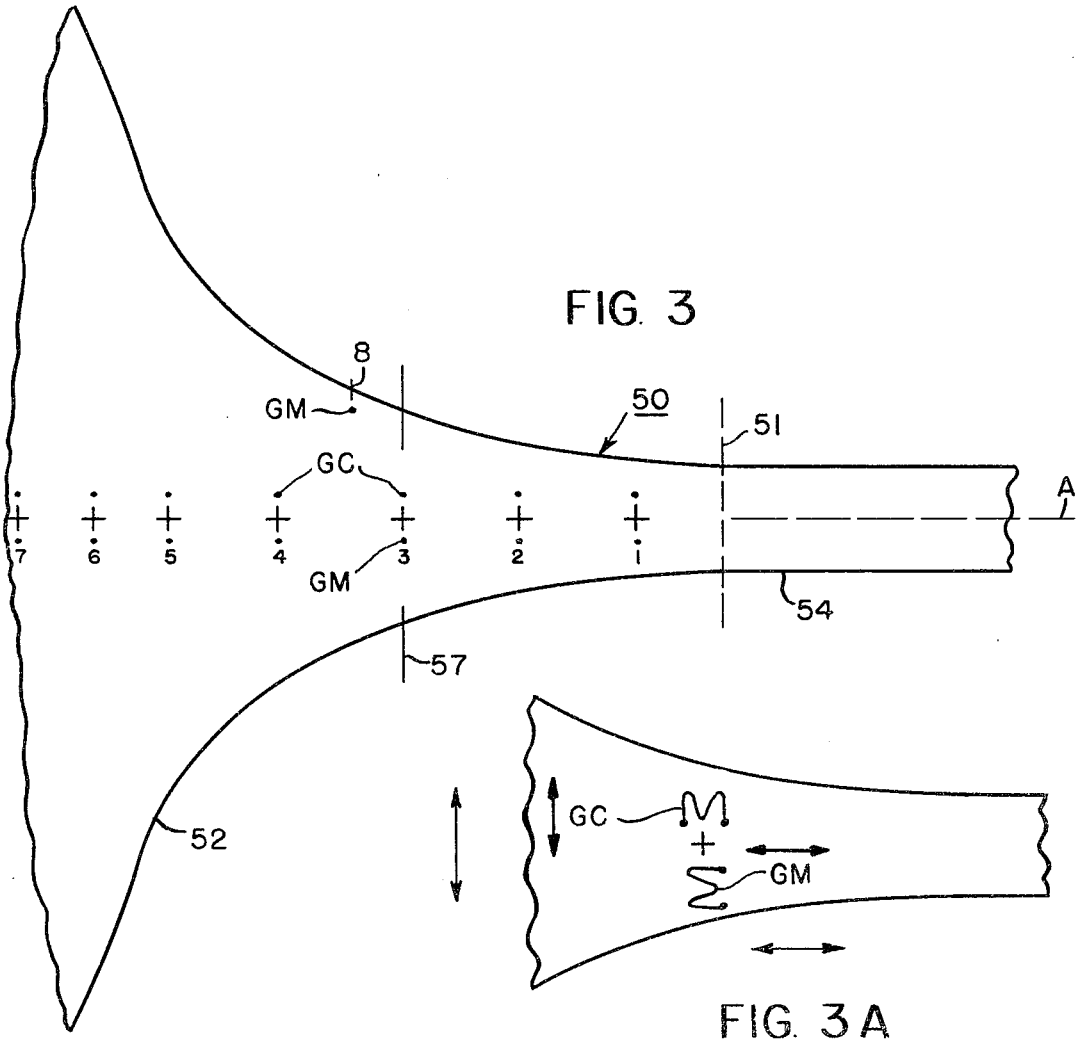
FIG. 3
FIG. 3A from Table I from Table II from Table III

IMPLOSION PROTECTION FOR TV TUBES

BACKGROUND OF THE INVENTION

This invention relates to a novel vessel or envelope structure which is adapted for use in the manufacture of cathode ray tubes and the like. More particularly the invention relates to a color television tube which sustains itself against very low internal pressure.

In FIG. 1, a prior art color television tube 10 is illustrated schematically. A panel 11, a funnel 12 and a neck 13 are each formed and fused together in a conventional manner. A pin and gun support 14 is inserted in an open end 15 of the neck 13 and sealed therealong. The entire tube 10 is evacuated in a conventional manner and one of various types of implosion protection devices, (e.g. tension or "T" band 16), is compressively disposed about the perimeter of the panel 11 in one of various ways known in the art. A force f represents a destructive impact on the panel 11 and the T band 16 exerts a radial force on the panel 11 in order to reduce the propagation of cracks therein caused by the destructive force f so that the tube 10 slowly devacuates in a manner which will prevent implosion.

Recent developments in the picture tube art have permitted manufacturers to increase the size of TV picture tubes substantially. As the size of television tubes becomes larger, the size, strength, and complexity of the T band arrangement must be greatly increased. For example, a test conducted by Underwriters' Laboratories Inc. subjects the frontal portion of the panel 11 to an impact of about 15 foot pounds delivered by a five pound missile. The amount of energy dissipated by the panel 11 is sufficient to destroy the tube so that glass fragmentation can be observed. Because of the nature of the test, it is necessary to design implosion protection systems to insure successful results should an implosion occur during normal use. This design requirement becomes increasingly difficult with the larger tubes since the evacuated space within the tube 10 and the stresses on the panel face 11 are progressively increased by the larger surface area exposed against the partial pressure of the tube.

In a copending application of Gehl et al., U.S. Ser. No. 029,555, filed the same date as the present disclosure and assigned to Corning Glass Works, the assignee herein, a stress relief notch molded into the funnel portion of the tube is disclosed. For reasons set forth in said disclosure, the position of the notch is preferably located in the funnel near the yoke reference line. Such preference is based upon reasons of safety, i.e. the glass is sufficiently thick to render the tube stable during processing and use. The present invention takes Gehl et al. a step further and suggests that a stress concentrating notch should be located in a zone of maximum stress concentration arising from the impact and have a controlled surface discontinuity to enhance crack off reliability.

The present invention has been made in order to supplement the conventional TV implosion protection device, in such a way that, a reliable outgassing or devacuation of the tube will occur without the necessity of increasing the hardware required for the conventional implosion protection.

DESCRIPTION OF THE DRAWINGS

FIG. 1 is a schematic diagram of a prior art TV tube showing conventional components and their environment in a side elevation.

FIG. 2 is a fragmented side elevation of a neck and funnel portion of the television tube according to the Gehl et al. prior invention.

FIG. 3 is a schematic showing the location of strain gauges used to take data described herein.

FIG. 3*a* is an enlarged fragmentary of a portion of FIG. 3.

SUMMARY OF THE INVENTION

Figure 4:
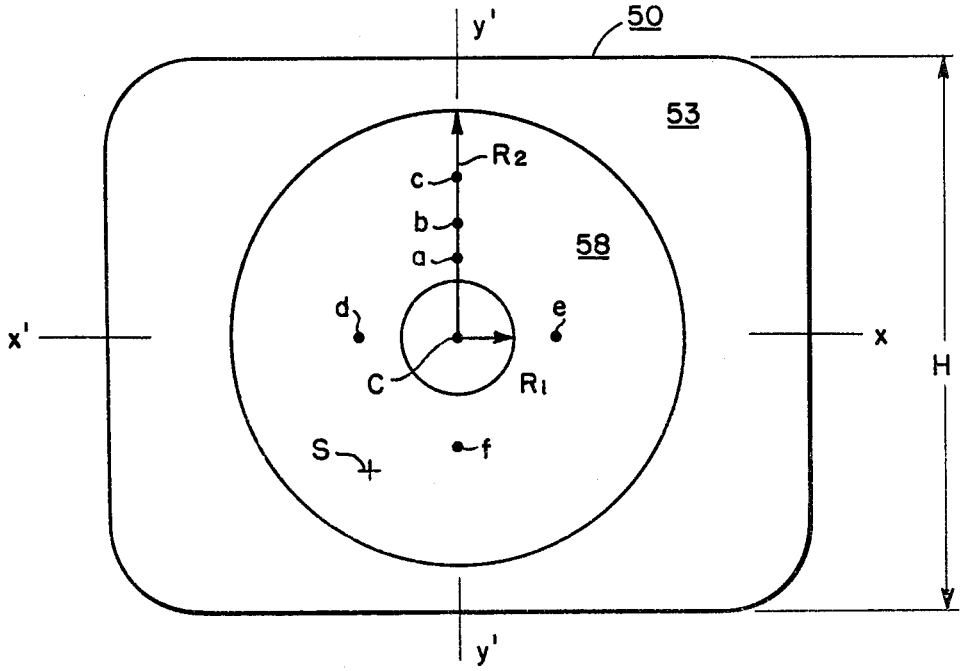
FIG. 4 is a schematic showing the geometry constraints for tests used to generate data described herein.

There has been provided a television tube having a funnel, panel, and neck portion fused together in a conventional manner. A circumferential implosion protection controlled surface discontinuity is formed in a rearward portion of the funnel for establishing a stress concentration location near a point of maximum stress therefor, such that in the event of a destructive impact to the panel, the tube will crack along the controlled surface discontinuity and reduce the implosion potential of the tube.

DESCRIPTION OF THE PREFERRED EMBODIMENT

In the conventional color television tube illustrated in FIG. 1, the destructive force f delivered by the typical test arrangement should be sufficient to crack the panel 11 causing a severe and rapid devacuation of the tube. As mentioned previously, the T band 16 reduces the severity of such a rapid devacuation, and thus reduces the implosion potential of the tube 10. As will be discussed hereinafter, the point of impact is an important parameter of the stresses imparted to the tube 10.

In FIG. 2, the Gehl et al. tube 20, including a portion of the funnel 22 and neck 23 is illustrated. Since other portions of the tube are similar to those illustrated in FIG. 1, they are omitted for clarity. The funnel 22 and neck 23 are fused along a parting line 24. A groove 25 is located just forward of a reference line 27, hereinafter described. The groove 25, sometimes referred to as a stress concentration notch, is circumferentially disposed about the rearward portion of the neck 22 in a plane perpendicular to a longitudinal axis A of the tube 20.

It has been found that, during testing according to the impact conditions set forth above, many television tubes of conventional design tend to crack in the vicinity of reference line 27, known in the art as the intersection of the tube by a plane perpendicular to the axis A of the tube 20 and passing through an empirically determined apex of beam deflection from the gun (not shown), (see also reference line 17 in FIG. 1). Thus, the Gehl et al. invention tends to amplify the tendency of the tube 20 to crack off in a controlled manner and location along groove 25.

It is not completely understood what the mechanism is for the propagation of shock waves and cracks in glass. However, it is believed that the shock propagation is substantially faster than crack propagation, and in the example illustrated in FIG. 1, if the force f causes a sufficient portion of the panel 11 to cave in, the shock produced by the force f will propagate its way along walls 18 of the tube 10 more rapidly than cracks produced in the surface of the panel 11. In FIG. 2, if the shock waves caused by the force f travel along walls 28 of the funnel 22 to the stress relief notch 25, the discontinuous nature of the notch 25 will cause the shock wave to concentrate in that area and result in a neck 23 crack off. Thus the tube 20 will devacuate rapidly but in a manner designed to relieve the implosion potential of the tube 20.

It should be realized that the T band 16 illustrated in FIG. 1 also protects the tube 20 herein from implosion. However, since the stress relief notch 25 provides a reliable source for the location of a crack off, the T band 16 for the larger types of tubes need only be a conventional design and sufficiently strong to protect the tube 20 from implosion for a time sufficient for the shock to propagate to the stress relief notch 25.

In FIG. 2 the stress relief notch 25 is a continuous circumferential groove including respective circumferential and radial faces 29 and 30 meeting at inside corner 31. It has been found that other designs are possible. For example, in the arrangement illustrated in FIG. 3 of Gehl et al. (not shown herein), a tube 30 has a segmented or discontinuous circumferential groove or stress relief notch in a location similar to that illustrated herein. For the reasons set forth in Gehl et al., the segmented notch is beneficial to the operation of the stress relief function and permits better processing selections.

In the Gehl et al., invention (see FIG. 2 herein) the notch 25 is shown as positioned for a 25" 90° tube with the leading edge 29 shown as about ¼" forward of the reference line 27. Experimentation by the inventor herein has shown that each tube experiences different stresses, and maximum stress is dependent on a number of parameters, including the tube geometry, location of gun support, the point of impact on the fact of panel, and whether or not the tube is evacuated. Thus, the location of the notch 25 in Gehl et al., may not necessarily be the choice of the inventor herein.

An important reason for this possible difference is that according to the present invention it is preferable to locate the controlled surface defect near a position of maximum stress resulting from the impact. In the testing of television tubes the point of impact of the force f may be varied across the panel of the tube, and it was discovered that the location and magnitude of maximum stress varies as the impact position is changed. Since one location would not satisfy all conditions, a program of experimentation was conducted to determine an optimum failure zone for the location of a predetermined or controlled surface discontinuity. To this end, the data below was taken with reference to an unnotched 25" 100° tube.

TABLE I

Stress vs. Gauge Position

| Gauge Location | Impact Location | Force Ft. Lb. | Evacuation Stress GC | Evacuation Stress GM | Impact Stress (Unevacuated) GC | Impact Stress (Unevacuated) GM | Net Stress GC | Net Stress GM |
|---|---|---|---|---|---|---|---|---|
| 1 | S | 3 | −1029 | −481 | 2880 | 3950 | 1851 | 3469 |
| 2 | S | 3 | −1122 | −1421 | 3640 | 6620 | 2518 | 5199 |
| 3 | S | 3 | −655 | −1252 | 2140 | 4870 | 1485 | 3618 |
| 4 | S | 3 | 236 | −37 | 1800 | 1550 | 2036 | 1513 |
| 5 | S | 3 | 420 | 494 | 2450 | 1820 | 2870 | 2314 |
| 6 | S | 3 | 176 | 499 | 2210 | 2340 | 2386 | 2839 |
| 7 | S | 3 | −189 | 110 | 1450 | 1890 | 1261 | 2000 |
| 8 | S | 3 | −363 | 284 | 1020 | 670 | 657 | 954 |

TABLE II

Impact Location vs. Stress

| Gauge Location | Effect of Impact Location | Impact Location | Energy Ft. Lb. | GC Stress | GM Stress |
|---|---|---|---|---|---|
| 2 | | S | 3 | 4160 | 7460 |
| | | C | 3 | 3210 | 4790 |
| | | b | 3 | 3120 | 6470 |
| | | e | 3 | 2570 | 3850 |

TABLE III

Impact Energy vs. Stress

| Gauge Location | Impact Location | Energy Ft. Lb. | GC Stress | GM Stress |
|---|---|---|---|---|
| 7 | S | 1 | 890 | 1160 |
| | S | 2 | 1270 | 1640 |
| | S | 3 | 1450 | 1890 |
| 2 | S | 1 | 2290 | 4130 |
| | S | 3 | 4160 | 7460 |
| | S | 5 | 5180 | 9400 |

In FIG. 3, a fragmented view of a tube 50 is illustrated with a rearward funnel portion 52 and neck portion 54 fused together at parting line 51. Gauges GC and GM, shown enlarged in FIG. 3*a*, are located on an outside wall of the tube 50 spaced in opposition transversely with minor axis Y–Y′ of tube 50 for each of the plurality of locations 1–7. Gauges for position 8 are located in opposition on the tube 50 transversely with the major axis X–X′.

Each of the gauges GC and GM is located in close proximity to each of the selected points 1–7 and 8. Each gauge is schematically represented in FIG. 3A as a resistance strain gauge, which may be deformed in the direction of the double headed arrow adjacent each one. Thus, gauge GC will deform circumferentially and gauge GM will deform meridionally or longitudinally of the tube should such respective stresses occur.

Gauge position 1 is located approximately 1" rearwardly of the reference line 57, gauge position 2 about ½" rearward of reference line 57, with gauge positions 3 and 4 being, respectively, on the reference line and ½" forward thereof. Gauge positions 5, 6 and 7 are spaced in successive ½" increments beyond position 4 in the forward direction. The gauge position 8 is located ¼" forward of the reference line 57 on major axis X–X′.

In FIG. 4 there is illustrated the useful or effective screen area of a front panel 53 of the tube 50. The height of the effective screen area is measured along the minor axis Y–Y′ as dimension H. The radial distance R1 is measured from the center C to a position 1/6H therefrom. The radius R2 is a line measured from the center C, and equals H/2–2". These dimensions define an annular space 58 on the front panel 53 of the tube 50, forming a target area for the Underwriters' Laboratories test. Position S in the annular space 58 is known as a standard impact position, which oftentimes is used in the impact test. It is approximately 4" down from the center and 2" to the left of center. Positions a, b and c are each respectively located in the annular space approximately 2", 4" and 6" up from the center. Positions d, e and f are each respectively approximately 4" to the left, right, and down from the center C.

The gauge positions are referred to in Table I above along with the data collected in connection with the evaluation of the present invention. The evacuation stress is given for the respective circumferential and meridional stresses measured by gauges GC and GM. Adjacent the evacuation stress data is impact stress for a tube having been let to air. Net stress, i.e., the sum of evacuation stress and impact stress is also listed in Table I. Unless otherwise noted, the impact is given in foot pounds and stress data is in psi. Most of the data shows impact at position S, but other locations are given for comparison elsewhere.

Figure 7A:
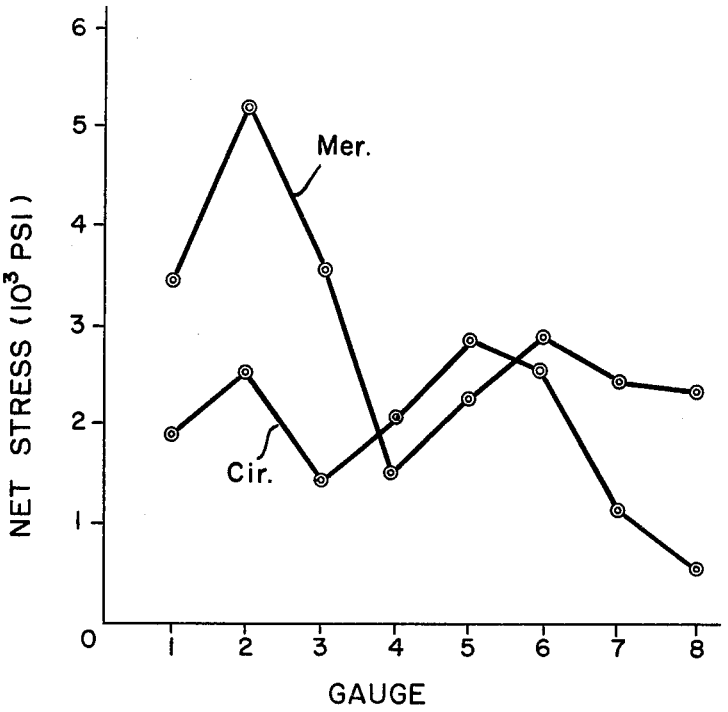
FIG. 7*a* is a plot of net stress versus gauge position data taken from Table I herein.

FIG. 7*a* is a plot of the data from Table I showing the net stress versus impact for gauge positions 1–8, plotted against gauge locations. It should be noted that a minus number for any stress value in Table I indicates that it is a compressive as opposed to a tensile stress. Thus, for example, the net meridional stress at gauge location 1 is given as 3950 +(−481) or 3469 psi. It is apparent that meridional stresses seem to be more pronounced.

Figure 7B:
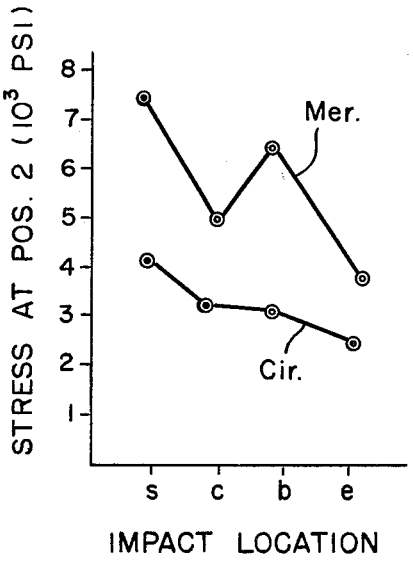
FIG. 7*b* is a plot of impact location versus stress from Table II herein.

Table II shows data comparing the stress detected at various impact positions. The plot of this data in FIG. 7*b* shows that, for various impact positions about the annular target region 58, the stress at the gauge location 2 can vary from about 2500 psi circumferentially at the impact position e to about approximately 7500 psi meridionally for impact at position S, with the same applied force. Thus, the impact location has an important bearing on the resulting stress and is a useful criterion in determining the location of the stress concentration notch.

Figure 7C:
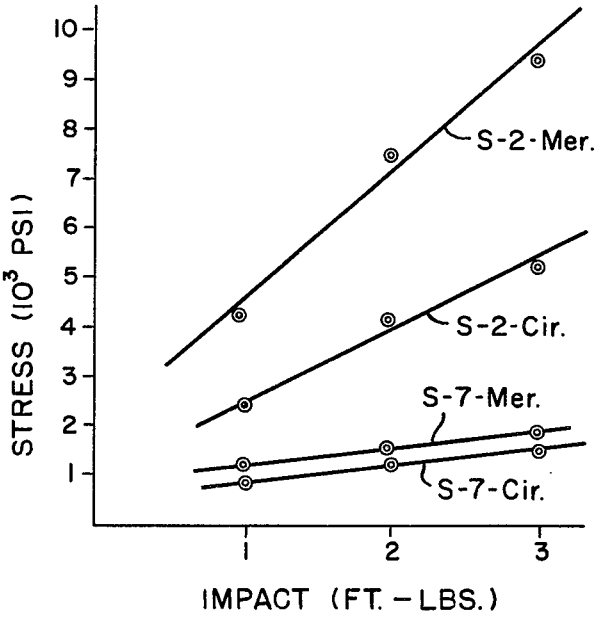
FIG. 7*c* is a plot of impact energy versus stress from Table III herein.

Low impact-nondestructive data was taken for the purpose of insuring that sufficient data could be compiled to verify the theory of the present invention. This low impact data was extrapolated and it was discovered that there is almost a linear relationship between the stresses measured as the impact energy is increased. Thus, it can be safely assumed that the relative stress imparted by an impact energy at one position will be increased or decreased in an almost linear relationship as said energy is increased or decreased. See FIG. 7*c* for a plot of the Table III data.

It should be realized that each of the Tables I–III are consistent with data taken and reported herein. However, experimental variations and errors must be used to explain differences in data for the same impact. For example a series of tests run on one tube should produce different data on another but the results are consistent and justify the explanations herein.

From the foregoing described data and from other experiments, it was determined that the stress relief notch 25 of the controlled failure zone should not only be located in a zone of maximum stress concentration from the impact, but also in an area where the evacuation stress on the tube is compressive. Thus, it was determined that the notch 25 should be located in the vicinity between gauge positions 1 and 3 (see FIG. 7*a*) when tube 20 is under vacuum (see Table I, negative stress indicates compression). The stress seems to concentrate in this area with higher values than at other gauge locations. The net stress plotted in FIG. 7*a* is the greatest in the zone mentioned above. This area has the greatest safety potential since the outer surface of the tube 20 is not in tension under vacuum.

Figure 5:
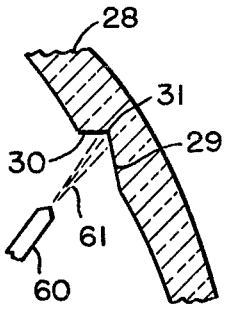
FIG. 5 is an illustration of an embodiment of the present invention in section.

Since the stress at a particular gauge location can vary by as much as a factor of 2 or perhaps more, depending on the variables, e.g. energy of impact, impact location, etc., means is suggested herein for enhancing the stress concentration at the stress concentration notch by providing a control surface discontinuity in the vicinity of the stress concentration notch. Enhancement of concentration increases the probability of a controlled neck crackoff. For example, referring now to FIG. 5, a side section of a stress concentrated notched tube 20 is illustrated. A nozzle 60 issues a sand blast jet 61 directed at or near the inside corner 31 of stress relief notch 25. By providing a control failure zone, as by sand blasting notch 25, the likelihood of stress concentration to cause a crackoff is enhanced without significantly weakening the tube 20.

Figure 6:
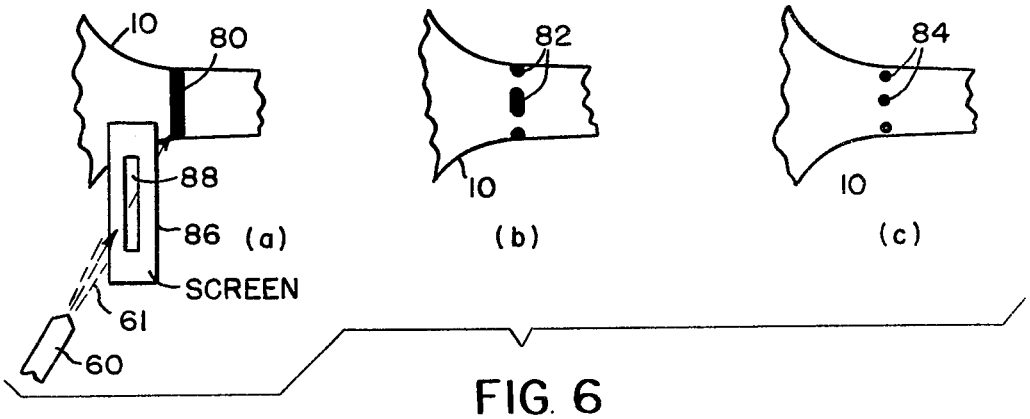
FIG. 6 is a schematic showing of other embodiments of the present invention, using sandblasted patterns for producing a controlled surface discontinuity.

In a preferred embodiment of the present invention, the foregoing conclusion is taken a step further. An envelope, such as tube 10 in FIG. 1, is simply fabricated in a conventional manner and a full or partial circumferential pattern is sand blasted into the neck/funnel region at a location of more or less maximum potential stress. In FIG. 6 (*a–c*) there are shown three sand blasted patterns of possible utility which could be used to create a controlled surface discontinuity without any other type of stress concentration device (e.g. notch). The pattern in FIG. 6(*a*) is a circumferential band 80, in 8(*b*) oblong stripes 82 (one or more possible along or away from various axes) and in 8(*c*) a series of dots 84. Each may be applied using a mask 86 and sandblast gun 60 (see FIG. 6(*a*)). As sand 61 is ejected from gun 60, mask 86 and pattern 88 cooperate to produce a pattern on tube 10 from the sand jet 61. Sandblasting alone to produce a controlled surface discontinuity is preferred, since, it can be accomplished using a conventional off line tube identification system. The technique does not damage the tube in any significant way and produces a controlled failure zone which is predictable and economically accomplished. Thus, if desired, even the molding of a groove 25 may be eliminated. The sand blast technique illustrated in FIG. 6*a* may use conventional tube identifying equipment to produce the desired pattern in an optimum location for the desired result.

While there have been described what at present are considered to be preferred embodiments of the present invention, it will be obvious to those skilled in the art that various changes and modifications may be made therein without departing from the invention, and it is intended in the appended claims to cover all such changes and modifications as fall within the true spirit and scope of the invention.

What is claimed is:

1. In a television tube having a neck, funnel, and panel, fused together in a conventional manner, an implosion protection controlled surface discontinuity is formed in a rearward portion of the funnel near a location of approximate maximum stress concentration for establishing a controlled failure zone for stress concentration, such that in the event of destructive impact to the panel, the neck and a rearward portion of the funnel of the tube will crack off in the failure zone as a result of the controlled surface discontinuity and reduce the implosion potential of the tube.

2. The tube of claim 1 wherein the controlled surface discontinuity comprises a notch in the form of a circumferential groove in said funnel portion lying in a plane perpendicular to a longitudinal axis of the tube.

3. The tube of claim 1 wherein the controlled surface discontinuity comprises a discontinuous circumferential groove formed in the said funnel portion lying in a plane perpendicular to a longitudinal axis for said tube.

4. The tube of claim 1 wherein the controlled surface discontinuity includes a sand blasted circumferential pattern of at least one area of said funnel.

5. The tube of claim 1 wherein the controlled surface discontinuity comprises a circumferentially disposed groove including a radial face and a tapering face of said groove meeting at a relatively sharp inside corner and having been subjected to sand blasting.

6. The tube of claim 5 wherein a sand blasted pattern includes at least one of: a continuous circumferential band, an elongated stripe and at least one dot.

7. The tube of claim 1 wherein said controlled surface discontinuity comprises: an abraded surface at the stress concentration location.

8. A method of forming a television tube having implosion protection wherein the neck funnel and panel are fused together in a conventional manner comprising the steps of: establishing a point near a rearward portion of the funnel exhibiting near maximum stress concentration, forming a controlled surface discontinuity in the vicinity of said point of maximum stress concentration and establishing a predetermined failure zone for stress concentration, such that in the event of a destructive impact to the panel, the neck and a rearward portion of the funnel of the tube will crack off in the failure zone substantially along the controlled surface discontinuity and reduce the implosion potential of the tube.

9. The method of claim 8 further including the steps of: establishing the controlled surface discontinuity by means of abrading the surface of the tube at said predetermined stress relief location.

10. The method of claim 9 wherein abrading is accomplished by sand blasting a pattern in the surface of said tube.

11. A funnel for use in a television tube having an implosion protection controlled surface discontinuity formed in a rearward portion of the funnel near a location of approximate maximum stress concentration for establishing a controlled failure zone, such that in the event of destructive impact to the tube, the funnel will be susceptible to failure in the controlled failure zone as a result of the controlled surface discontinuity and reduce the implosion potential of the tube.

12. A method of forming a television tube funnel having implosion protection comprising the steps of: establishing a point near a rearward portion of the funnel exhibiting near maximum stress concentration, forming a controlled surface discontinuity in the vicinity of said point of maximum stress concentration and thereby establishing a predetermined failure zone for stress concentration, such that, in the event of a destructive impact to the tube, the funnel will be susceptible to failure in the failure zone substantially along the controlled surface discontinuity and reduce the implosion potential of the tube.

* * * * *